United States Patent [19]

Trecker

[11] 4,034,518

[45] July 12, 1977

[54] PORTABLE COT AND TABLE CONVERTIBLE INTO CARRYING CASE

[76] Inventor: Francis J. Trecker, 7100 Mummy Mountain Road, Scottsdale, Ariz. 85253

[21] Appl. No.: 656,112

[22] Filed: Feb. 9, 1976

[51] Int. Cl.[2] ..... A45F 1/00

[52] U.S. Cl. ..... 5/114; 5/112; 5/310; 43/109; 190/11

[58] Field of Search ..... 312/266, 242, 244, 241; 5/3, 6, 110, 111, 112, 114, 200, 310; 248/236, 188.1, 346.1; 43/109; 190/2, 11; 108/34

[56] References Cited

U.S. PATENT DOCUMENTS

| | | | |
|---|---|---|---|
| 989,012 | 4/1911 | Hoyt | 43/109 |
| 1,043,743 | 11/1912 | Westerstrom | 5/3 |
| 1,154,923 | 9/1915 | Holden | 248/238 |
| 1,520,589 | 12/1924 | Matkovic | 5/310 |
| 1,820,315 | 8/1931 | Miller | 248/238 |
| 2,292,110 | 8/1942 | Evans | 43/109 |
| 2,514,644 | 7/1950 | Irving | 190/2 |
| 2,522,322 | 9/1950 | Wallace | 190/11 |

*Primary Examiner*—Casmir A. Nunberg
*Attorney, Agent, or Firm*—Cyril M. Hajewski

[57] ABSTRACT

A portable cot and table which folds into a carrying case in which bedding or other equipment may be packed for travel and storage. Extensions may be added to the basic cot so that the length of the cot can be increased to accommodate the particular person using it. The legs are extensible so that the flat sleeping surface can be raised to the normal height of a table. Removable cups are provided for receiving each of the legs of the cot and the cups may be filled with a repellant or insecticide to prevent insects from crawling up the legs of the cot.

11 Claims, 15 Drawing Figures

Fig. 5
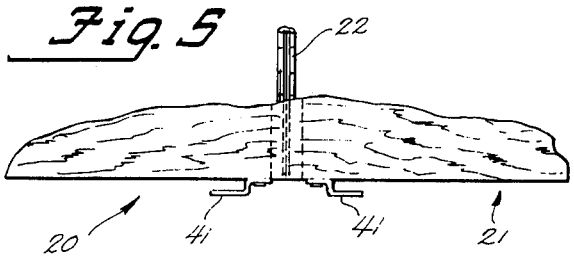
Fig. 6
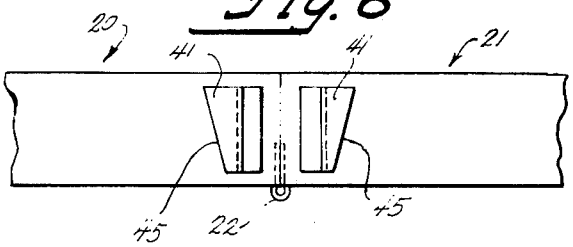
Fig. 7
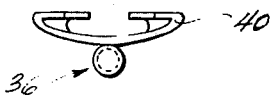
Fig. 8
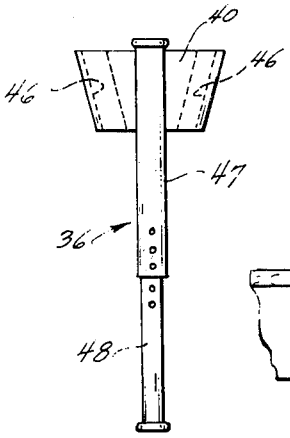
Fig. 9
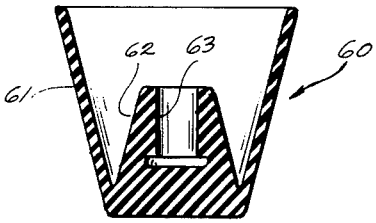
Fig. 10
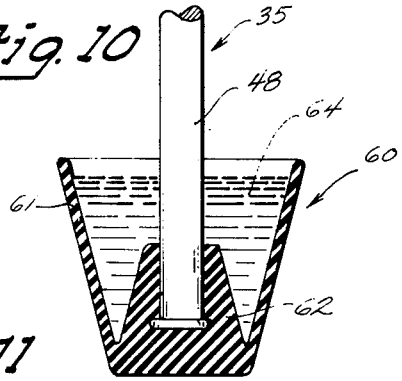
Fig. 11
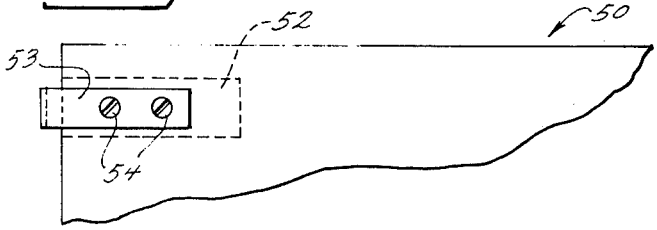
Fig. 12
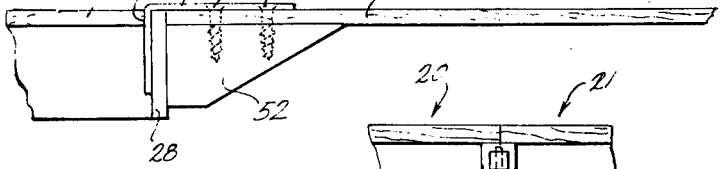
Fig. 13
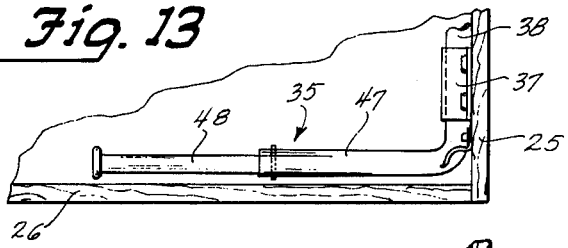
Fig. 14
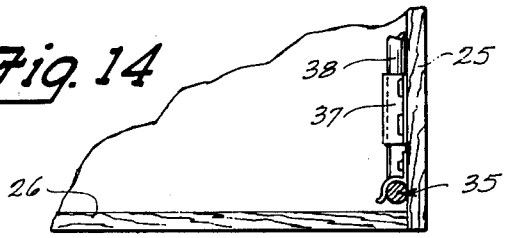
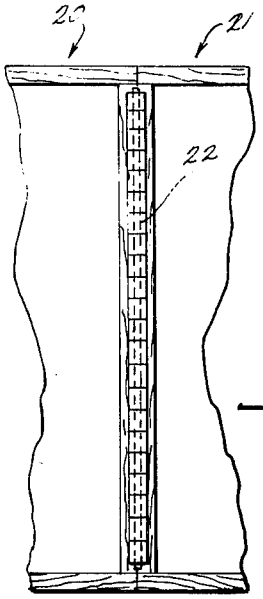
Fig. 15

PORTABLE COT AND TABLE CONVERTIBLE INTO CARRYING CASE

BACKGROUND OF THE INVENTION

Portable cots that may be collapsed to form a carrying case have been found generally unsatisfactory for several reasons. First of all they have been formed so that the entire cot folds to form the carrying case and if the cot is to be large enough to accommodate an adult human being, the case becomes extremely large and cumbersome or the cot cannot be used by persons of average height.

In addition, such portable cots are relatively unstable because of the several hinged sections so that they do not give a firm support to the sleeper and are therefore uncomfortable.

It is therefore a general object of the present invention to provide an improved portable cot that can be collapsed into a carrying case for carrying bedding and other equipment.

The improved portable cot of the present invention folds into a carrying case of convenient size but is provided with extensions that can be added to both ends for increasing the length of the cot to accommodate the height of the person using it.

Another object of the present invention is to provide a portable collapsible cot and table that opens into an extremely rigid structure to provide firm support for the person using it by reinforcing the unit at the hinged section to improve its stability.

Another object is to provide a cot with extensible legs so that its flat surface can be raised to the normal height of a table to enable it to be used as a table.

A further object of the present invention is to provide cups adapted to receive the legs of the cot and table so that an insecticide or repellant may be placed in the cups to prevent insects from crawling up the legs of the cot.

SUMMARY OF THE INVENTION

The improved portable camping cot and table of the present invention comprise two box sections of equal size hinged to each other so that they can fold into a closed box like structure that forms a carrying case but said box sections can swing away from each other to form a flat surface on which a person can sleep or which can be used as a table.

The four corner legs of the cot are hinged and swing into the case when not in use. On the other hand, they may be pivoted outwardly to support the cot on the ground or floor in a horizontal position when it is to be used. Two additional legs are provided for centrally supporting the flat surface at each end of its hinge. These two legs are provided with brackets at the top that engage cooperating cleats on the box sections to securely hold the two box sections together for forming a rigid structure that greatly increases the stability of the cot. All six of the legs are extensible to raise the height of the flat horizontal surface to enable the unit to be used as a table.

An extension is also provided for one end of each of the box sections to increase the length of the cot to accommodate the sleeper. Either both, one, or none of the extensions can be employed to suit the particular circumstances. These extensions slip into firm engagement with the box sections without the use of screws or similar fasteners.

Cups may also be stored in the carrying case and each cup has a socket for receiving a leg of the cot. The cups may be filled with a repellant or insecticide to prevent pests from crawling up the legs of the cot.

The foregoing and other objects of this invention which will become more fully apparent from the following detailed description, may be achieved by means of the exemplifying apparatus depicted in and set forth in this specification in connection with the accompanying drawing.

BRIEF DESCRIPTION OF THE DRAWING

FIG. 5 is a fragmentary plan view illustrating the tapered cleats at the center of the cot and table for receiving the cooperating brackets of the two center legs;

FIG. 6 is a fragmentary side elevational view illustrating the tapered cleats shown in FIG. 5;

FIG. 7 is a detail plan view of one of the center legs of the cot and table showing the tapered bracket for engagement with the cleats depicted in FIGS. 5 and 6;

FIG. 8 is a detail elevational view of the leg shown in FIG. 7;

FIG. 9 is a view in vertical taken through the center of one of the cups which receive the legs of the cot and table of the present invention;

FIG. 10 is a view in vertical section taken through the center of the cup shown in FIG. 9 but with a leg in the socket of the cup and the latter containing a fluid;

FIG. 11 is a fragmentary plan view illustrating a corner of one of the extensions that may be added to the cot and table to increase its length;

FIG. 12 is a fragmentary view partially in vertical section and partly in elevation showing the extension depicted in FIG. 11 assembled to a box section of the cot and table;

FIG. 13 is a fragmentary bottom view showing a corner leg of the cot and table pivoted to its storage position against the flat surface of the underside of the cot and table;

FIG. 14 is a fragmentary bottom view illustrating the corner leg shown in FIG. 13 pivoted outwardly to its operating position; and FIG. 15 is a fragmentary bottom view depicting the piano hinge extending along the entire width of the cot and table at its center.

DESCRIPTION OF THE PREFERRED EMBODIMENT

Figure 1:
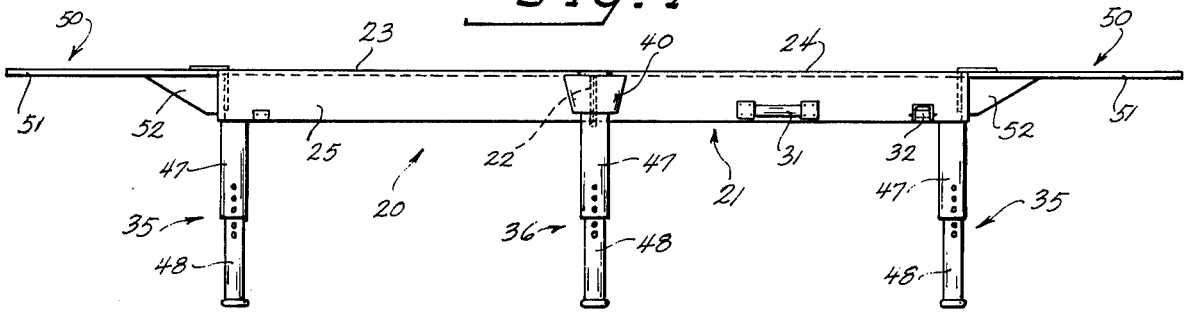
FIG. 1 is a view in side elevation showing the portable cot and table of the present invention in its open condition with both extensions and its legs assembled in position to render the cot ready for use.

Reference is now made more particularly to the drawings which illustrate the improved portable cot and table of the present invention comprising two box sections generally identified by the reference numerals 20 and 21. These two box sections are connected together by a piano hinge 22 shown in FIGS. 3 and 15 so that the two box sections may be pivoted outwardly to present the flat surfaces or plates 23 and 24 in a horizontal p plane to form one contiguous flat surface upon which a person may sleep or which may be used as a table.

In order to form the box sections, the section 20 includes the flat plate 23 and two oppositely disposed long sides 25 which are perpendicular to the flat plate 23. To complete the box section, the section 20 includes two short sides 26 that are perpendicular to the flat plate 23 and form right angles with the long sides 25.

In like manner, the box section 21 is formed by two oppositely disposed long sides 27 which extend perpendicularly from the two opposite edges of the flat plate 24. The box section is completed by a pair of short sides 28 that extend along the opposite short edges of the flat plate 24 and perpendicular to and form right angles with the long sides 27.

Figure 3:
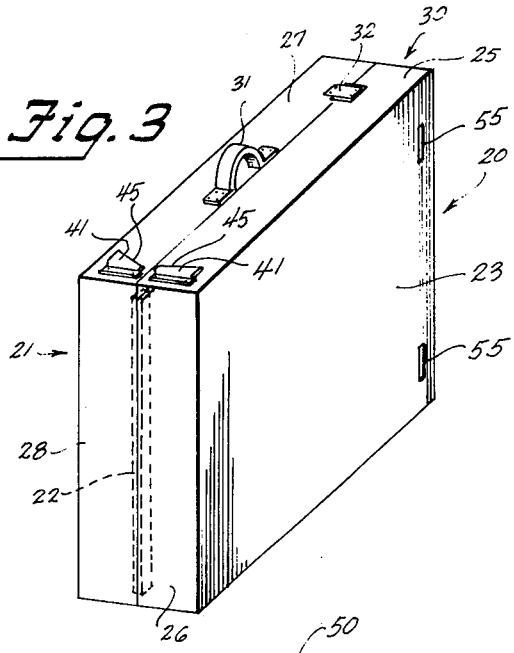
FIG. 3 is a perspective view of the portable cot and table depicted in FIG. 1 in its collapsed condition to form a carrying case.

The box sections 20 and 21 may be pivoted toward each other to the position shown in FIG. 3 to form a carrying case generally identified by the reference numeral 30. In this position the box sections 20 and 21 form an enclosure in which items can be stored for travel or storage. Thus, bedding and camping equipment can be stored within the carrying case 30 if the unit is to be used while camping. In order to facilitate the carrying of the case 30 a handle 31 is provided along the center portion of one of the sides 27 of the box section 21 as illustrated in FIG. 3. With this arrangement, the case 30 may be carried about in the manner of a suitcase. Clasps 32 are provided along the sides 25 and 27 for locking the two box sections 20 and 21 in the closed position. One clasp 32 is depicted in FIG. 3 but another identical clasp 32 (not shown) is provided on the opposite side of the carrying case 30, in alignment with the clasp 32 that is illustrated.

Figure 4:
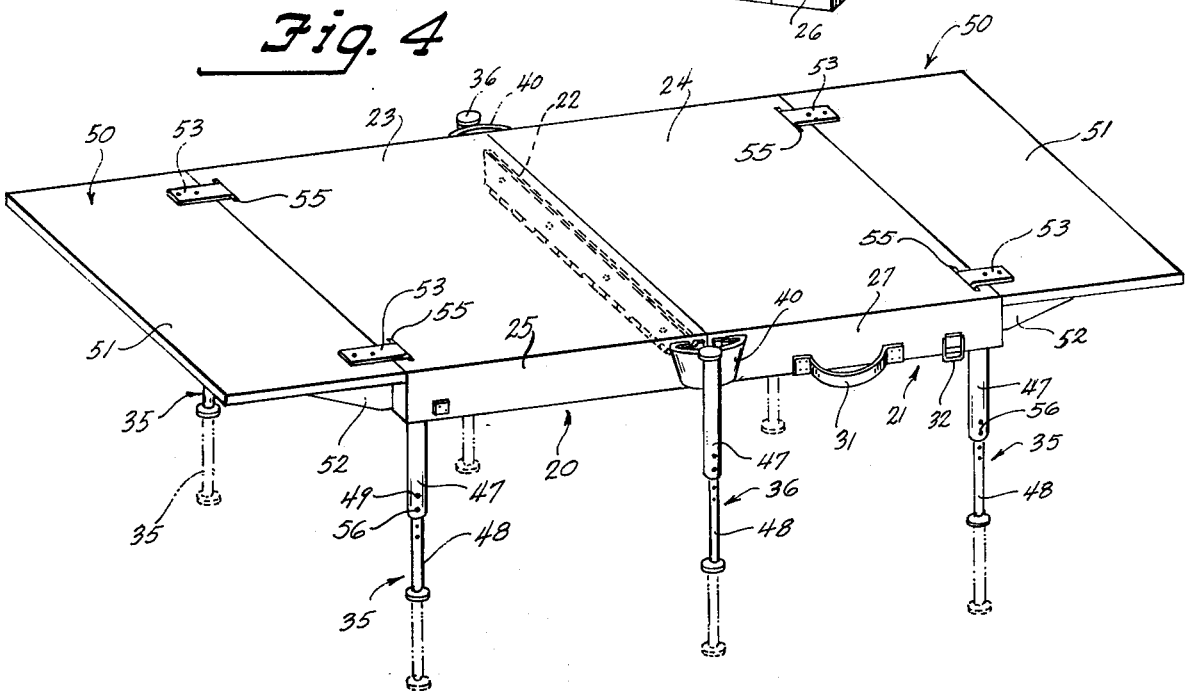
FIG. 4 is a perspective view showing the portable cot and table depicted in FIG. 1 in its open condition with both extensions and its legs assembled in position to render the cot ready for use.

The box sections 20 and 21, when in the open position as shown in FIGS. 1 and 4 are supported in a horizontal position above the ground by four extensible corner legs generally identified by the reference numeral 35 and two extensible center legs generally identified by the reference numeral 36. Thus, the box section 20 is provided with a corner leg 35 at each of its two corners opposite the hinge 22. In like manner, the box section 21 is provided with a corner leg 35 at each of its two corners opposite the hinge 22. Each of the corner legs is pivotably supported by its associated box section in the manner illustrated in FIGS. 13 and 14. As there shown, each of the corner legs 35 is pivotably carried by a bracket 37 that is mounted on one of the sides of its associated box section. In FIG. 13, the bracket 37 is shown mounted on the side 25 of the box section 20. The leg 35 is provided with a right angle extension 38 that engages the bracket 37 and is pivotal with respect thereto. Accordingly, the leg 35 may be pivoted into the box section for storage as illustrated in FIG. 13 or it may be pivoted outwardly from that position to the position shown in FIG. 14 for supporting a box section in an open position.

In order to provide further rigidity and stability to the entire structure, two center legs 36 are provided. One center leg 36 is disposed on each side of the cot, centrally located so that they are at the location of the hinge 22 where the two box sections 20 and 21 join.

Each of the legs 36 is provided with a bracket 40 for engagement with a pair of cooperating cleats 41 on the box sections 20 and 21. As clearly shown in FIGS. 5, 6 and 7 a cleat 41 is mounted on the box section 20 and another cleat 41 is mounted on the box section 21 so that when the box sections 20 and 21 are open to present a contiguous flat surface, the two cleats 41 are adjacent to each other. Both of these cleats cooperate with the single bracket 40 on the associated leg 36. The cleats 41 are tapered so that together they form an inverted frustum. The bracket 40 is also tapered as shown in FIG. 8 to complement the taper of the cleats 41 and is also of frusto conical configuration. Thus, each of the cleats 41 is provided with a tapered surface 45 while the bracket 40 is provided with two tapered surfaces 46. When the leg 36 is assembled to the unit, the upper wider end of the bracket 40 is slid upwardly onto the narrower bottom ends of the cleats 41 and is moved until its tapered surfaces 46 engage the two tapered surfaces 45 of the cleats 41. This serves to tightly clamp the box sections 20 and 21 together so that they cannot spread apart to greatly add to the rigidity and stability of the assembled cot. Thus, the engagement of the bracket 40 with the cleats 41 functions as a clamp to clamp the two box sections 20 and 21 together.

The legs 35 and 36 are extensible so that the flat surfaces 23 and 24 can be raised from the normal height of a cot to a height that is sufficient to enable the unit to be used as a table with the flat surfaces 23 and 24 serving as the table top. To this end each of the six legs is formed of two tubular sections 47 and 48 with the section 47 being of a diameter sufficiently large so that the section 48 can slide into its bore so that the section 48 will telescope into the section 47. As clearly shown in FIG. 2 the tubular sections 47 and 48 are provided with a plurality of transverse holes 49 so that the holes 49 of section 47 can be aligned with holes 49 of section 48 for receiving a pin 56 to lock the two sections together at the desired height. The holes in all six legs are identically arranged and identified so if the same holes are aligned on all six legs and locked in position the legs will all be of the same length for evenly supporting the flat surfaces 23 and 24 in a horizontal position.

In FIG. 4 the legs 35 and 36 are shown in solid lines in their retracted condition for supporting the flat surfaces 23 and 24 at a height suitable for sleeping purposes. On the other hand the legs 35 and 36 are illustrated in broken lines in their extended position to support the flat surfaces 23 and 24 at a height that is ideal for a table so that the unit can then be utilized as a table.

Figure 2:
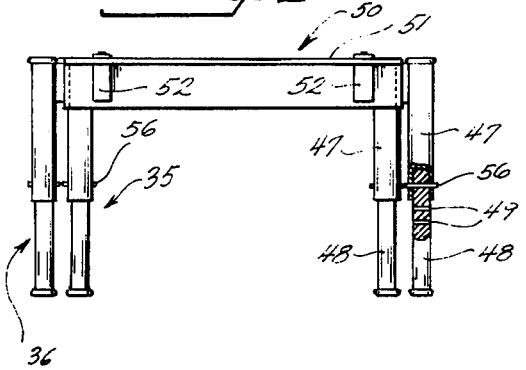
FIG. 2 is an end view of the portable cot and table illustrated in FIG. 1.

In order to increase the length of the assembled unit, two extensions 50 are made available and the unit is illustrated in FIGS. 1 and 2 with both extensions 50 assembled to it. Thus, one extension 50 is on the left side of the cot as shown in FIGS. 1 and 4 and another extension 50 is shown on the right side of the cot. It is to be understood that the use of these extensions is optional depending upon the height of the person utilizing the cot and one, both, or none of these extensions may be assembled depending upon the circumstances. Each of the extensions 50 is identical and they comprise a flat plate 51 having a pair of angular supports 52 on its underside. An L shaped retainer 53 is fastened by screws 54 to the plate 51 directly above each of the supports 52 so that one leg of the retainer 53 extends downwardly of the plate 51 but is spaced from the edge of the support 52 as clearly shown in FIGS. 11 and 12. The flat surfaces 23 and 24 of the box sections 20 and 21 respectively are provided with slots 55 for receiving the depending leg of the retainer 53. Thus, as shown in FIG. 12, the depending leg of the retainer 53 extends through the slot 55 and bears against one surface of the short side 28 of the box section 21 while the edge of the angle support 52 bears against the opposite surface of the same short side 28. With this arrangement, the L shaped retainers 53 cooperate with the angle supports 52 to carry the extensions 50 so that their plates 51 are contiguous with the flat surfaces 23 and 24 of a box section 20 and 21 respectively to form one continuous flat surface upon which a person may lie or which will constitute a table top.

In the event the unit is used in an area where insects or other pests may crawl up the cot or table, the cups 60 as shown in FIGS. 9 and 10 may be added to the bottom of the legs 35 and 36 to prevent the insects from crawling up the legs. The cups 60 are of frustoconical configuration and are provided with an upwardly and outwardly extending circular wall 61 to form a cup with a boss 62 extending upwardly from the bottom of the cup but within the wall 61. The boss 62 is provided with a central bore 63 for receiving the bottom of the leg 35 or 36. The cup is filled with a repellant or insecticide 64 as shown in FIG. 10 so that in order to reach the leg 35 the insect must first enter the insecticide 64. The cup 60 is preferably made of a flexible material such as neoprene so that it will not break and will occupy a minimum amount of space.

From the foregoing detailed description of the illustrative embodiment of the invention set forth herein it will be apparent that there has been provided an improved portable camping cot or table that can be collapsed into a carrying case for carrying bedding, camping equipment or the like. The portable cot and table of the present invention is of extremely rigid construction to provide stability to the unit and its length may be adjusted to accommodate sleepers of varying heights. In addition the legs of the unit are adjustable as to length so that the unit may be used as a cot or its flat sleeping surface may be raised sufficiently to enable it to be conveniently used as a table. Moreover, suitable protection is provided to prevent pests from crawling up the legs of the unit to bother the users.

Although the illustrative embodiment of the invention has been described in considerable detail for the purpose of disclosing a practical, operative arrangement by means of which the invention may be practised advantageously, it is to be understood that the particular portable cot and table illustrated and described is intended to be illustrative only and that the various novel characteristics of the invention may be incorporated in other structural forms without departing from the spirit and scope of the invention as defined in the subjoined claims.

The principles of this invention having now been fully explained in connection with the foregoing description, I hereby claim as my invention:

1. In a portable cot that is collapsible into a carrying case; a pair of box sections, each presenting an open side and an opposite closed side and being pivotably connected to each other so that the two box sections can be pivoted away from each other to an open position with their closed sides in the same plane to present a contiguous flat surface that a person can lie on and said box sections can be pivoted toward each other to a closed position with their open sides facing each other to form an enclosure; a pair of legs pivotably supported by each of said box sections so that said legs can be pivoted into the box section for storage and may be pivoted outwardly therefrom to operating position wherein the four legs will support the two box sections above the ground with the open sides facing the ground and the closed sides presenting a flat contiguous top in a horizontal position; and clamping means rigidly locking said two box sections together in the open position to provide rigidity and stability to the cot.

2. A portable cot according to claim 1 including an extension; and means for mounting said extension to one of said box sections so that it presents a flat surface contiguous with the flat surface presented by its associated box section to selectively increase the length of the cot.

3. A portable cot according to claim 1 including a center leg adapted to support said cot at the juncture of said two box sections and wherein said clamping means comprises; a pair of cleats mounted on said box sections with one cleat being on one box section adjacent its edge and the other cleat being on the other box section adjacent its edge so that the two cleats cooperate; and a bracket mounted on the top of said center leg and being adapted to embrace both of said cleats and apply a force to them tending to draw the two box sections together while at the same time supporting them in a horizontal position above the ground.

4. A portable cot according to claim 3 including a tapered edge on each of said cleats so that the two cleats present two tapered edges inclined in opposite directions, and a pair of tapered surfaces on said bracket complementing the two tapered surfaces on said cleats so that as the bracket is moved onto the cleats the tapered surfaces on the brackets engage the tapered surfaces on the cleats to draw the two box sections together and secure them.

5. A portable cot according to claim 4 including an extension; and means for mounting said extension to one of said box sections so that it presents a flat surface contiguous with the flat surface presented by its associated box section to selectively increase the length of the cot.

6. A portable cot according to claim 5 wherein each of said box sections pivotally supports two legs so that said legs can be pivoted into the box section for storage and may be pivoted outwardly to operating position wherein the four legs will support the two box sections above the ground in a horizontal position; two removable center legs at the juncture of said two box sections with one center leg being disposed on each side of the cot to cooperate with said clamping means for providing additional rigidity and stability to the cot; removable cups for receiving the bottom end of each of said legs, a boss extending upwardly from the bottom of each of said cups and presenting a socket for receiving the bottom of one of the legs so that the leg may be inserted into the socket and the cup filled with a liquid repellant or insecticide to prevent pests from crawling up the leg to the occupant of the cot.

7. A portable cot according to claim 1 wherein each said legs comprises two tubular coaxial sections with one section telescoping into the other section so that the lengths of the legs can be adjusted to enable the flat surface to be supported at a height for sleeping on it or it may be raised to a height to enable it to be used as a table top, and means locking said two tubular sections together at the desired length.

8. In a portable cot that is collapsible into a carrying case; a pair of box sections, each presenting an open side and an opposite closed side; a hinge connecting said box sections together so that they can be pivoted away from each other to an open position so that the two closed sides present a contiguous top flat surface that a person can lie on and said box sections can be pivoted toward each other to a closed position with their open sides facing each other to form an enclosure; a plurality of legs that can be placed in operating position to support said box sections when they are in the open position with the open sides facing downwardly so that the opposite closed sides form a contiguous top side in a horizontal plane; a removable extension; and mounting means for mounting said extension to one of said box sections so that it presents a flat surface contiguous with the flat top surface presented by its associated box section to selectively increase the length of the cot.

9. A portable cot according to claim 8 wherein said box sections are formed of a plurality of structural members and said mounting means comprises a plurality of L shaped members each having one leg of the L secured to said extension and the other leg of the L depending downwardly therefrom through an opening in the flat surface of said box section into engagement with a structural member of the box section for supporting the extension in position.

10. A portable cot according to claim 9 including a support depending from the underside of said extension in alignment with said L shaped member and presenting a surface spaced from the depending leg of said L shaped member so that said structural member fits between them whereby said support is located on one side of said structural member and the depending leg of said L shaped member is located on the other side of said structural member to firmly support the extension in operating position.

11. A portable cot according to claim 8 wherein each of said legs comprises two tubular coaxial sections with one section telescoping into the other section so that the lengths of the legs can be adjusted to enable the flat surface to be supported at a height for sleeping on it or it may be raised to a height to enable it to be used as a table top, and means locking said two tubular sections together at the desired length.

* * * * *